United States Patent [19]

Macht et al.

[11] 4,119,225

[45] Oct. 10, 1978

[54] MOUNTING MEANS FOR ATTACHING AN IMPLEMENT TO A VEHICLE

[75] Inventors: Jon A. Macht; David L. Blinne, both of Owatonna, Minn.

[73] Assignee: Owatonna Manufacturing Company, Inc., Owatonna, Minn.

[21] Appl. No.: 788,127

[22] Filed: Apr. 18, 1977

[51] Int. Cl.[2] ..... E02F 3/81

[52] U.S. Cl. ..... 214/145 A; 172/273

[58] Field of Search ..... 214/145 A, 131 A; 172/272, 273, 275

[56] References Cited

U.S. PATENT DOCUMENTS

| | | | |
|---|---|---|---|
| 3,398,983 | 8/1968 | Olsson | 172/272 |
| 3,794,195 | 2/1974 | Clevenger et al. | 214/145 A |
| 3,818,551 | 6/1974 | Coughran, Jr. | 214/145 A |
| 3,984,016 | 10/1976 | Kuhn | 214/145 A |

FOREIGN PATENT DOCUMENTS

| | | | |
|---|---|---|---|
| 106,518 | 6/1965 | Norway | 214/145 A |

*Primary Examiner*—Albert J. Makay
*Assistant Examiner*—Ross Weaver
*Attorney, Agent, or Firm*—Merchant, Gould, Smith, Edell, Welter & Schmidt

[57] ABSTRACT

A frame mounted on the lifting arms of a vehicle for lifting and loading materials, the frame having a releasable connection to an implement to be carried by the lifting arms and frame and operated from the vehicle. A locking device, carried by the frame, is operative to releasably lock the implement to the frame and to hold the implement against movement relative to the frame when locked thereto.

2 Claims, 5 Drawing Figures

MOUNTING MEANS FOR ATTACHING AN IMPLEMENT TO A VEHICLE

BACKGROUND OF THE INVENTION

This invention relates to mechanisms for effecting quick attachment of implements to the lifting booms or arms of a vehicle, such implements including scoops, lifting forks and the like; for securely holding the implement attached to the vehicle; and for quick and easy release of the implement from the vehicle.

Some coupling devices heretofore produced have been rather difficult to manipulate, requiring shifting of the vehicle during coupling of the implement thereto. Others have, of necessity, used loosely interfitting coupling elements, resulting in slack or lost motion between the implements and the connections thereof to the vehicle.

SUMMARY OF THE INVENTION

The mounting means of this invention involves a generally horizontally elongated and generally downwardly opening channel on the implement, and means on said implement defining a recess generally downwardly spaced from said channel and having a generally vertical axis. A frame is mounted on the vehicle for upward and downward movements relative to the vehicle and includes a horizontally elongated rigid frame member disposed to be seated in said channel, and a rigid bar in downwardly spaced parallel relation to the frame member for abutting engagement with said implement above said recess defining means, responsive to movement of said frame toward the implement and upward movement of said frame relative to said implement. The mounting means further includes a locking bolt having a tapered lower end portion, guide means mounted on the frame for said bolt, a support pin mounting said bolt for axial movements in said guide means, yielding means urging said bolt relative to said support pin toward reception of said tapered end portion in said recess, and linkage for moving said bolt away from locking reception of said tapered end portion in said recess against bias of said yielding means.

DETAILED DESCRIPTION OF THE PREFERRED EMBODIMENT

Figure 1:
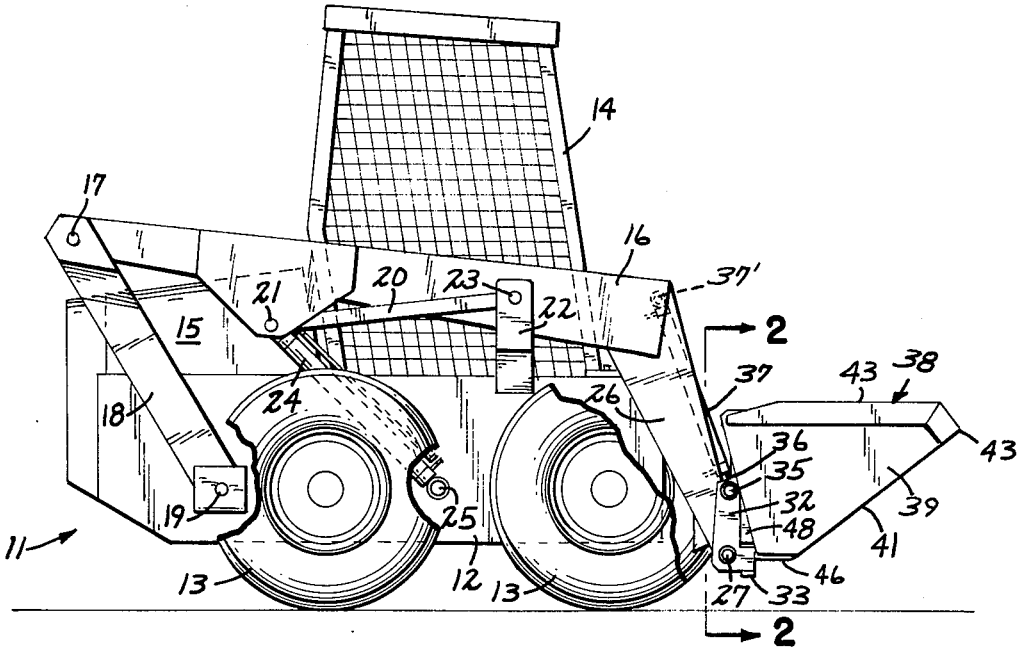
FIG. 1 is a view in side elevation of a vehicle having lifting arms thereon and a scoop mounted on the lifting arms by the mounting means of this invention, some parts being broken away.

A vehicle, indicated generally at 11, is in the nature of a tractor or what is commonly known as a front end loader, and comprises a frame 12 supported by pneumatic tire equipped wheels 13, one pair of the wheels being shown in FIG. 1. A cage-like operator's cab 14 projects upwardly from the frame 12, and an engine for driving the vehicle may be assumed to be contained under a hood 15.

A pair of generally L-shaped lifting booms or arms 16 are pivotally secured at their rear ends, as at 17, to the upper ends of supporting members 18, the lower ends of which are pivotally mounted on the frame 12, as indicated at 19. Swinging movement of the arms or booms 16 are controlled by the members 18 and bars 20 having opposite ends pivotally connected to respective ones of the arms 16 generally forwardly of the pivot connections 17, as indicated at 21, and their opposite ends pivotally connected to brackets 22 projecting upwardly from the frame 12, and as indicated at 23. Lifting and lowering movements are imparted to the booms 16 by hydraulic rams 24 connected to the booms 16 as at 21, and to the frame 12 at 25. While only one each of the booms 16, supporting members 18, bars 20, brackets 22 and rams 24, are shown in FIG. 1, it will be understood that each of these are two in number, there being one at either side of the vehicle. The vehicle 11, with the parts thereof above described, do not in and of themselves comprise the instant invention. Hence, in the interest of brevity, further detailed showing and description thereof is omitted. It should suffice to state that each of the arms or booms 16 include downwardly projecting leg portions 26, the lower ends of which have aligned openings therethrough for reception of coupling shafts 27 extending therethrough. As shown, the shafts 27 are disposed on a common generally horizontal axis extending transversely of the direction of travel of the vehicle 11.

Figure 2:
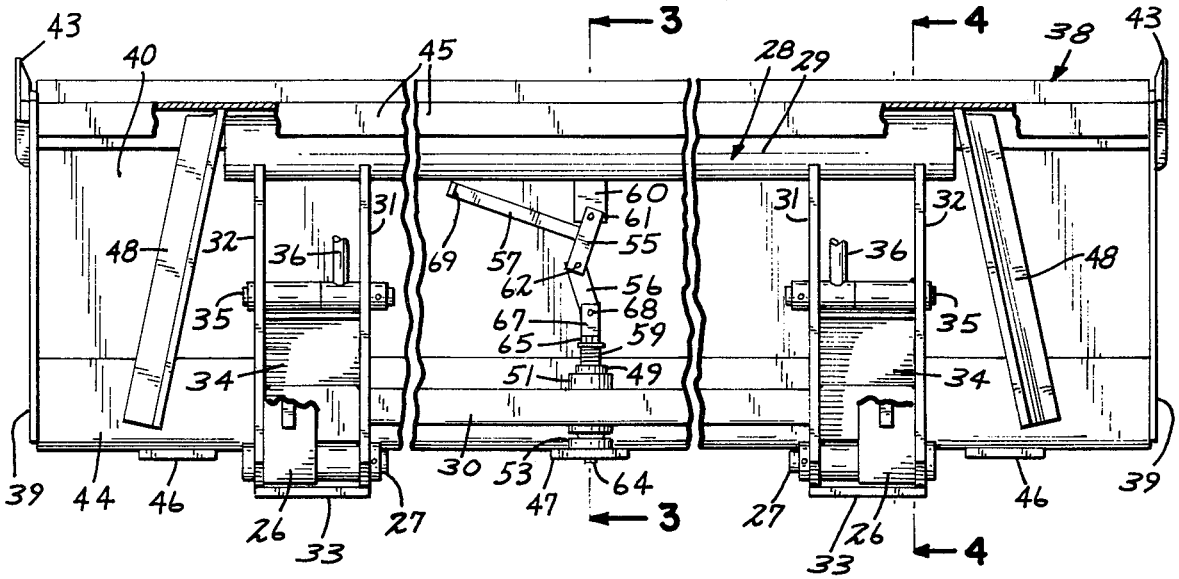
FIG. 2 is an enlarged fragmentary view partly in rear elevation and partly in section, as seen from the line 2—2 of FIG. 1.

A support frame 28 comprises a pair of elongated horizontal upper and lower frame members 29 and 30 respectively, and laterally spaced pairs of inner and outer generally vertical frame members 31 and 32 respectively welded or otherwise rigidly connected at their upper ends to the upper frame member 29. The upper frame member 29 is in the nature of a rigid cylindrical tube, the lower frame member 30 being preferably in the nature of a cross sectionally rectangular tube, see particularly FIG. 3. The lower frame member 30 is welded or otherwise rigidly connected at its opposite ends to the inner vertical frame members 31, as shown in FIG. 2. The lower ends of the frame members 31 are connected to their respective outer frame members 32 by connecting bars 33, and intermediate their ends by strengthening webs 34. The frame members 31 and 32 have aligned openings therethrough for reception of the coupling shafts 27, whereby the frame 28 is pivotally supported by the lifting arms or booms 16. Intermediate their ends, the frame members 31 and 32 have aligned horizontal openings which receive pivot shafts 35 on which are journaled the lower ends of piston rods 36 of hydraulic rams 37 that are connected to the booms 16 as shown by dotted lines in FIG. 1 and indicated at 37'. The rams 37 and their cooperating piston rods 36 operate to pivotally move the frame 28 about the common axis of the coupling shafts 27 as required during operation of the machine.

The support frame 28 is adapted to be coupled to various implements, such as scoops, loading forks and the like. In the drawings, an elongated scoop is shown and indicated generally at 38, the same having a pair of laterally spaced end walls 39, a normally generally vertical rear wall portion 40, and a normally forwardly and upwardly sloping wall portion 41 connected to the rear wall portion 40 by a cross sectionally arcuate bottom wall portion 42, see particularly FIG. 3. Preferably, the end walls 39 and upper edge portion of the sloping wall portion 41 are reinforced by sharp edged cutting bars 43. An elongated angle bar 44 extends from one end wall 39 to the other end wall 39 and is welded at its opposite edges to the rear and bottom wall portions 40 and 42 respectively, and a horizontally disposed downwardly opening channel member 45 extends between the end walls 39, being welded or otherwise rigidly secured to the rear wall portion 40 adjacent its upper edge. The scoop 38 is further reinforced by a pair of laterally spaced outer wear plates 46 that are inwardly spaced from the opposite ends of the scoop 38, as shown in FIG. 2, and an intermediate wear plate 47 located generally centrally between the opposite ends of the scoop 38, and wear plates 46 and 47 extending downwardly and rearwardly along the sloping wall portion 41 and rearwardly of the rear wall portion 40 and angle bar 44.

Figure 3:
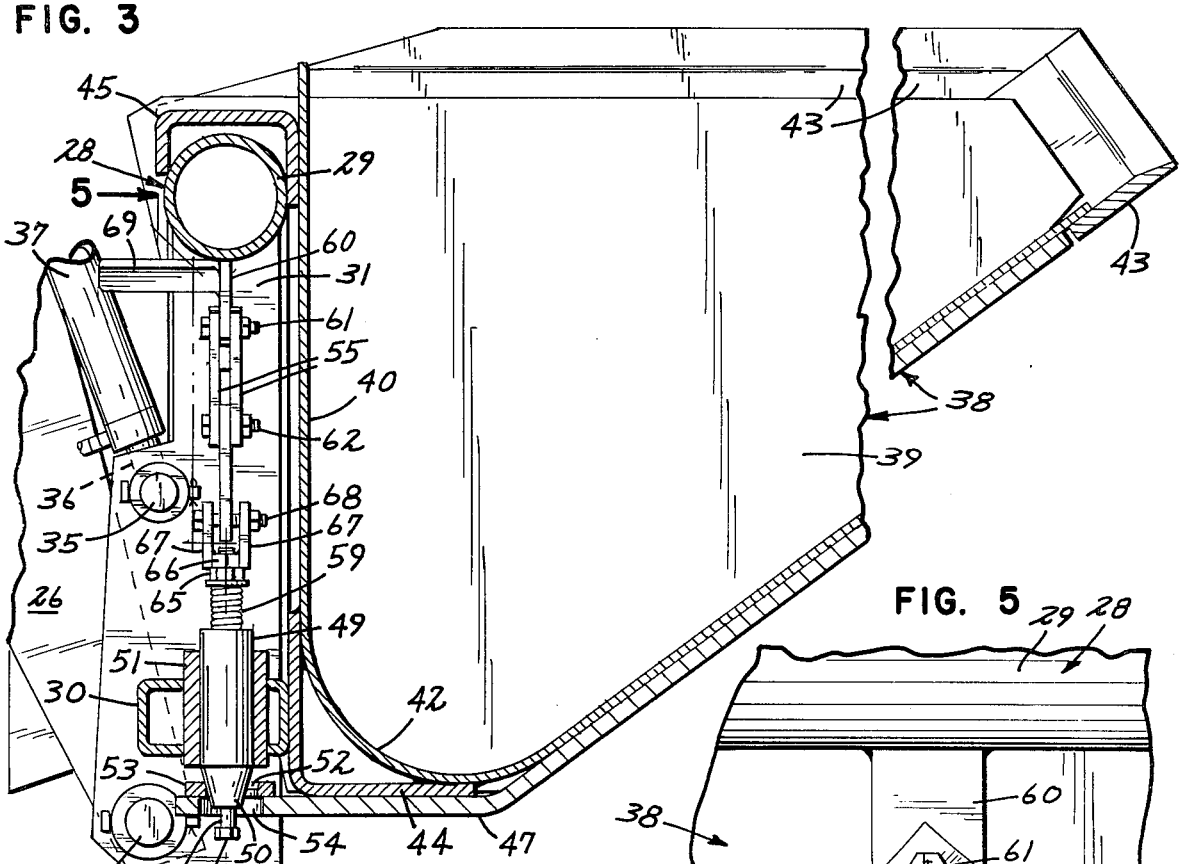
FIGS. 3 and 4 are further enlarged fragmentary transverse sections taken on the lines 3—3 and 4—4 respectively of FIG. 2.
Figure 4:
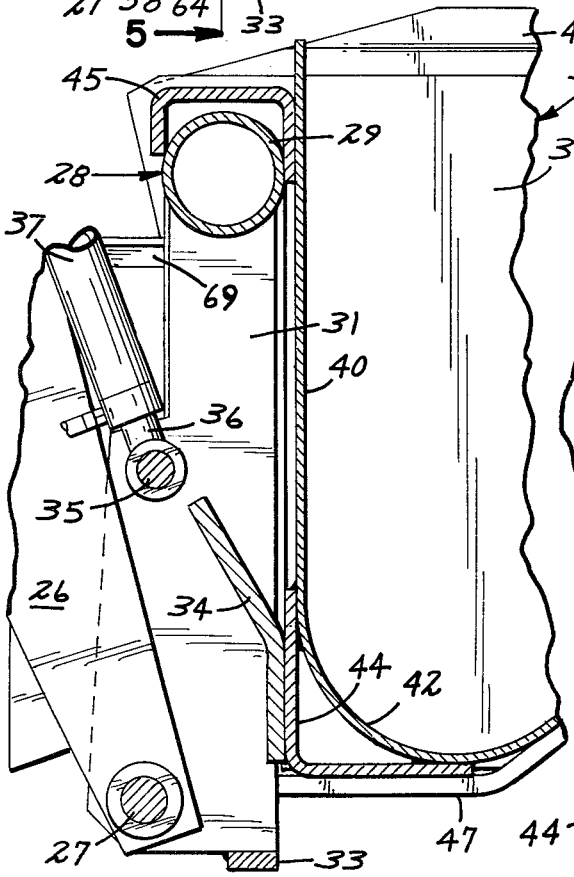

As shown in FIGS. 2–4, the upper frame member 29 is adapted to be partially received in or seated in the channel member 45 when the support frame 28 is moved into engagement with the scoop 38. To cause the frame 28 to be connected to the scoop 38, it is merely necessary for the operator of the vehicle to energize the rams 37 to cause the support frame 28 to be tilted forwardly and upwardly, and move the vehicle 11 forwardly until the upper tubular frame member 29 engages the rear wall 40 of the scoop 38. The lifting arms or booms 16 are then raised so that the upper frame member 29 is at least partially received within or seated in the channel member 45, causing the scoop 38 to be raised with the support frame 28. As this occurs, the scoop 38 swings downwardly and rearwardly until the angle bar 44 abuttingly engages the lower frame member 30, as shown in FIG. 3. A pair of upwardly converging guide members 48 are secured at their upper ends to the channel member 45 and at their lower ends to the angle bar 44, and serve to guide the support frame 28 to a position centrally between the opposite ends of the scoop 38.

For the purpose of locking the scoop 38 to the support frame 28, a locking bolt 49 is provided on the support frame 28. A locking bolt 49 is disposed on a normally generally vertical axis and has a downwardly tapering lower end portion 50, the bolt 49 being axially slidably mounted in a tubular bearing 51 extending transversely through the lower frame member 30 and mounted fast therein. The locking bolt 49 is adapted to be at least partially received in a recess or opening 52 of a strike plate 53 welded or otherwise rigidly mounted on the rear end portion of the wear plate 47. The wear plate 47 is also provided with an opening 54 axially aligned with the opening 52, to freely admit entrance therein of the lower end portion of the locking bolt 49.

Means for moving the locking bolt 49 axially of the tubular bearing 51 and into and out of locking engagement with the strike plate 53 comprises upper and lower toggle links 55 and 56, a handle 57, an elongated support pin in the nature of a machine screw or bolt 58, and a coil compression spring 59. The upper toggle links 55, of which there are two, have outer ends that are pivotally secured to an ear 60 depending from the upper frame member 29 by means of a pivot screw 61, the inner ends of the upper toggle links 55 being pivotally secured to the inner end of the toggle link 56 by means of a nut equipped pivot screw 62. The support pin 58 extends longitudinally slidably through an axial opening 63 through the locking bolt 49, the support pin 58 having an enlarged head 64 at its lower end that is movable into and out of engagement with the lower end of the locking bolt 49. The upper end portion of the support pin 58 is threaded to receive a washer equipped lock nut 65 that operatively engages one end of the spring 59, the spring 59 encompassing the support pin 58 above the locking bolt 49 and having its lower end abutting the upper end of the locking bolt 49 to yieldingly urge the bolt 49 toward engagement of its lower end with the head 64 of the support pin 58. The extreme upper end of the support pin 58 is screw threaded into a nut portion 66 of a U-shaped bracket 67 that is pivotally connected to the outer end of the lower toggle link 56 by means of a nut equipped pivot screw 68. It will be noted that the axes of the pivot screws 61, 62 and 68 are parallel and transverse to the direction of movement of the locking bolt 49 and support pin 58. The operating handle 57 has its inner end disposed between the upper toggle links 55, and is welded or otherwise rigidly secured thereto. The handle 57 engages the link 56 to limit swinging movements of the toggle links 55 and 56 in one direction relative to each other, the outer end portion of the handle 57 engaging the frame member 29 to limit swinging movements of the toggle links 55 and 56 in the opposite direction relative to each other.

Figure 5:
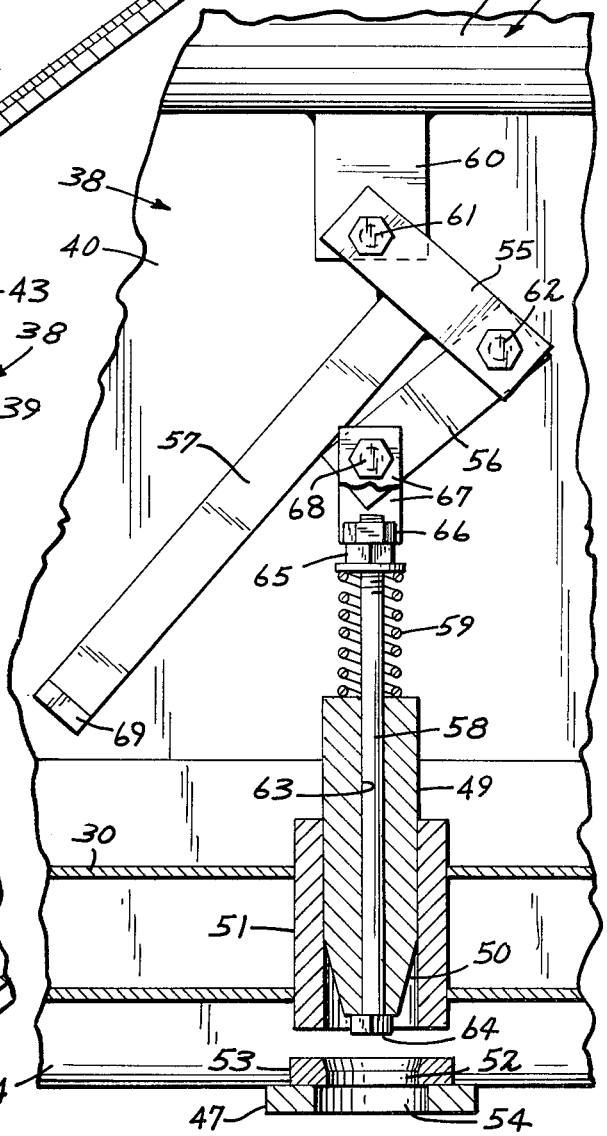
FIG. 5 is a still further enlarged fragmentary view, partly in rear elevation and partly in section, taken on the irregular line 5—5 of FIG. 3.

In FIG. 5, the toggle links 55 and 56, and handle 57 are disposed in positions wherein the locking bolt 49 is withdrawn from the opening 52 in the strike plate 53. When the handle 57 is swung upwardly from its position of FIG. 5, to its limit of movement in an upward direction, as shown in FIG. 2, the toggle links 55 and 56 move in directions to lower the locking bolt 49 to its operative locking position wherein the lower tapered end portion 50 is received in the opening 52 in the strike plate 53. With reference to FIG. 3, it will be seen that the support pin 58 moves downwardly with respect to the locking bolt 49, so that the spring 59 is compressed to hold the locking bolt 49 in engagement with the strike plate 53. It will be further noted that when the lower frame member 30 is in abutting engagement with the angle bar 44, the axis of the locking bolt 49 is laterally displaced from the axis of the strike plate opening 52, so that the tapered end portion 50 engages a side portion of the opening 52 to provide a wedging or camming action against the strike plate 53 to hold the lower frame member 30 against the angle bar 44. With reference to FIG. 2, it will be seen that when the handle 57 is raised to its upper limit of locking movement, the toggle links 55 and 56 move slightly beyond a dead center relationship and are held in this position by yielding bias of the spring 59. Preferably, the handle 57 is formed at its outer end to provide a laterally outwardly projecting portion 69 that may be easily reached by the operator to set or release the locking bolt 49.

It will be appreciated that any desired implement may be provided with a downwardly opening channel member for seating engagement with the frame member 29, and further provided with a strike plate for reception of the locking bolt, to securely hold a desired implement on the mounting frame 28.

While a preferred embodiment of the implement mounting means of this invention has been shown and described, it will be understood that the same is capable of modification without departure from the spirit and scope of the invention, as defined in the claims.

What is claimed is:

1. Mounting means for attaching an implement to a vehicle, said mounting means comprising:

(a) a generally horizontally elongated and generally downwardly opening channel member on said implement;

(b) means on said implement defining a recess generally downwardly spaced from said channel and having a generally vertical axis;

(c) a frame mounted on said vehicle for upward and downward movements relative to said vehicle and including a horizontally elongated rigid frame member disposed to be seated in said channel member, and a rigid bar in downwardly spaced parallel relation to said frame member for abutting engagement with said implement above said recess defining means, responsive to movement of said frame toward said implement and upward movement of said frame relative to said implement;

(d) a cylindrical locking bolt having a tapered lower end portion and an axial opening therethrough;

(e) guide means on said frame for said bolt;

(f) a support pin extending axially slidably through said axial opening and mounting said bolt for axial movements in said guide means;

(g) a coil spring encompassing said support pin above said bolt and yieldingly urging said bolt relative to said support pin toward reception of said tapered end portion in said recess;

(h) said tapered lower end portion of the bolt being disposed eccentric to said recess in a direction away from said implement when said frame is in abutting engagement with said implement, whereby said tapered end portion exerts a wedging action against a portion of said recess to hold said rigid bar in said abutting engagement with said implement;

(i) and linkage for moving said bolt away from locking reception of said tapered end portion in said recess against bias of said yielding means.

2. The mounting means defined in claim 1 in which said linkage comprises a pair of toggle links having inner ends pivotally connected together and outer ends, further including means operatively pivotally connecting one of said outer ends to said frame and pivotally connecting the other outer end to said support pin, and an operating handle on one of said toggle links disposed to engage the other of said toggle links and said frame member to limit pivotal movement of said links in opposite directions relative to said frame.

* * * * *